US008323791B2

(12) United States Patent
Murakami

(10) Patent No.: US 8,323,791 B2
(45) Date of Patent: Dec. 4, 2012

(54) POLYAMIDE FILAMENT AND INDUSTRIAL FABRIC USING THE POLYAMIDE FILAMENT

(75) Inventor: Shinya Murakami, Shizuoka (JP)

(73) Assignee: Nippon Filcon Co., Ltd. (JP)

( * ) Notice: Subject to any disclaimer, the term of this patent is extended or adjusted under 35 U.S.C. 154(b) by 729 days.

(21) Appl. No.: 11/270,530

(22) Filed: Nov. 10, 2005

(65) Prior Publication Data

US 2006/0106176 A1 May 18, 2006

(30) Foreign Application Priority Data

Nov. 17, 2004 (JP) ..... 2004-333072

(51) Int. Cl.
*C08L 77/00* (2006.01)
*D01F 6/60* (2006.01)
*B29C 55/12* (2006.01)

(52) U.S. Cl. ..... 428/364; 428/357; 428/359; 428/401; 525/420; 525/432

(58) Field of Classification Search ..... 525/420, 525/432; 428/357, 359, 364, 401
See application file for complete search history.

(56) References Cited

FOREIGN PATENT DOCUMENTS

| | | |
|---|---|---|
| EP | 0786544 | 7/1997 |
| EP | 0839862 | 5/1998 |
| JP | 67025497 | * 11/1964 |
| JP | 06 287807 | 10/1994 |
| JP | 7-9550 | * 1/1995 |
| JP | 9-228142 | * 9/1997 |

OTHER PUBLICATIONS

XP002046583—Database WPI Week 199445, Derwent Publications LTD., London, GB; AN 1994-364092.
European Search Report for corresponding European dated Sep. 14, 2007 for Application No. EP-05257033.0-1217.

* cited by examiner

*Primary Examiner* — Ana Woodward
(74) *Attorney, Agent, or Firm* — Rader, Fishman & Grauer PLLC

(57) ABSTRACT

A polyamide filament is disclosed. The filament includes a polyamide resin. The resin is obtained from mixing crystalline polyamide (A) with another polyamide (B). Crystalline polyamide (A) is obtained by a polycondensation reaction of metaxylenediamine and adipic acid. Crystalline polyamide (A) comprises from 5 to 50 wt. % of the resin. Polyamide (B) comprises from 50 to 95 wt. % of the resin. The filament is heated to 160 to 200° C. under a constant length condition at an initial load of 20 mg/d. After heating, a thermal contraction stress of the filament is not reduced in a cool-down region not greater than 80° C.

1 Claim, 1 Drawing Sheet

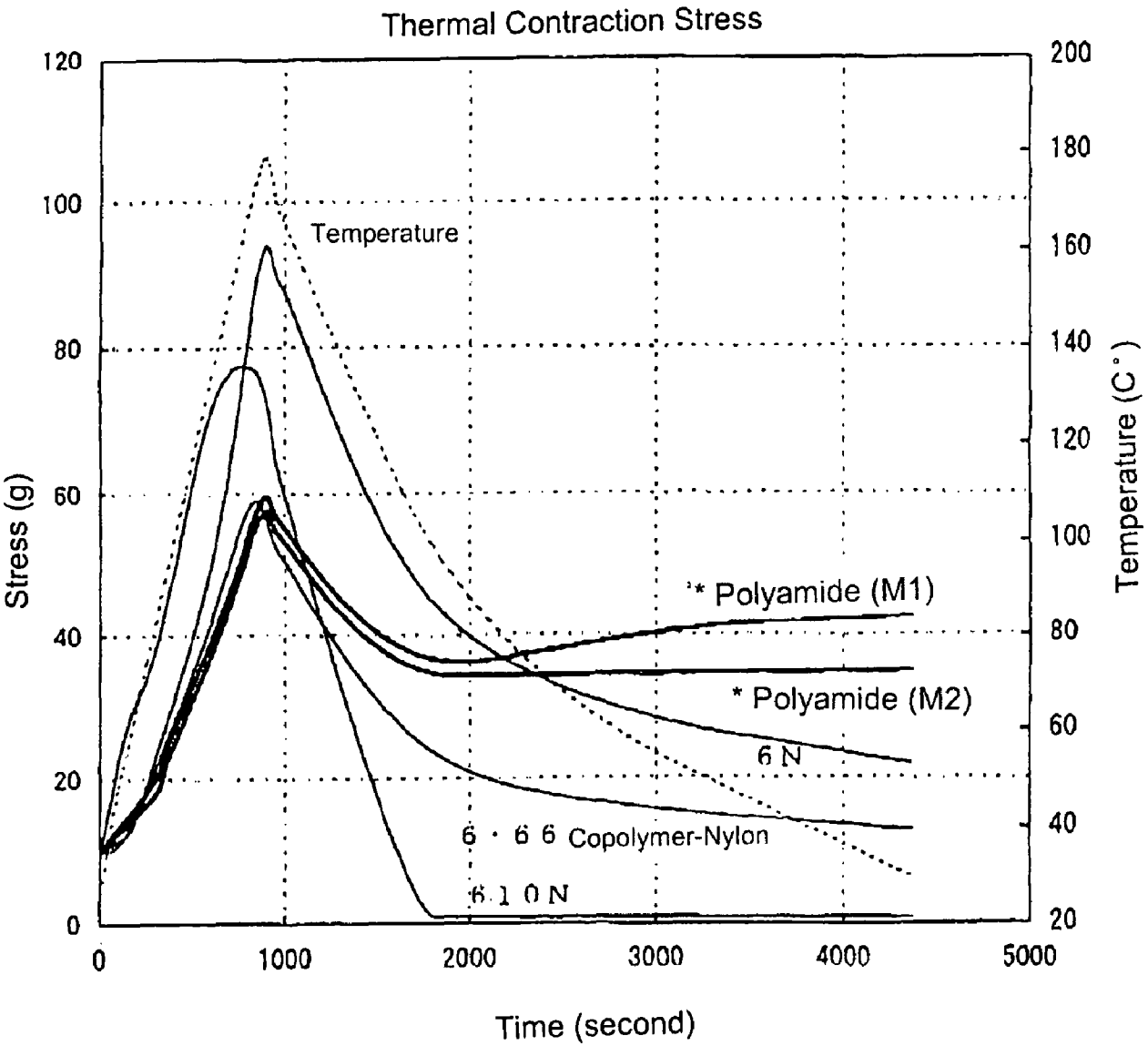
Thermal Contraction Stress
Temperature
* Polyamide (M1)
* Polyamide (M2)
6 N
6 · 6 6 Copolymer-Nylon
6 1 0 N
Stress (g)
Temperature (C°)
Time (second)
0
20
40
60
80
100
120
140
160
180
200
1000
2000
3000
4000
5000

POLYAMIDE FILAMENT AND INDUSTRIAL FABRIC USING THE POLYAMIDE FILAMENT

TECHNICAL FIELD

The present invention relates to a polyamide filament used for industrial fabric, which filament is obtained by mixing certain amounts of specified two polyamides and does not reduce its thermal contraction stress even by cooling to room temperature after heating; and an industrial fabric using this filament. The industrial fabric obtained using the filament is excellent in fabric rigidity such as diagonal rigidity and flexural rigidity, weaving strength, dimensional stability, running stability, fibrillation resistance, wear resistance, resistance to moist heat, heat resistance, and chemical resistance and is stable without causing misalignment of constituent yarns; and is suited for papermaking fabric, filter cloth of a dehydrator or conveyer belt.

BACKGROUND OF THE INVENTION

Fabrics obtained by weaving, as warps and wefts, monofilaments made of a synthetic resin have conventionally been used widely as an industrial fabric. They are, for example, used in various fields including papermaking fabrics, filter cloths and conveyor belts and are required to have fabric properties suited for the intended use or using environment. Of these fabrics, a papermaking fabric used in a papermaking step such as removal of water from raw materials by making use of the network of the fabric must satisfy severe requirements. There is therefore a demand for the development of fabrics which are equipped with fabric rigidity such as diagonal rigidity and flexural rigidity, dimensional stability and wear resistance high enough to permit preferable use under severe environments; and can maintain conditions necessary for making good paper for a prolonged period of time. In addition, surface property, fiber supporting property, improvement in a papermaking yield, good water drainage property and running stability are required. In recent years, owing to the speed-up of a papermaking machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by using a papermaking fabric as a representative example.

Physical properties which a papermaking fabric must have include rigidity, dimensional stability, wear resistance, surface property, fiber supporting property, improved yield of raw materials for paper manufacture, good water drainage property and running stability. A variety of studies on the fabric design, quality of yarns and weaving conditions and trial production based on such studies have been performed in order to satisfy such requirements. Among factors having a great influence on the physical properties of a fabric, yarns constituting a fabric are important so that researchers have carried out an extensive investigation on their main components, additives, mixing ratio, and characteristics of yarns.

In Japanese Patent Laid-Open Publication No. 2000-144531, disclosed is a polyamide monofilament excellent in wear resistance and heat set property and an industrial cloth which is obtained using the polyamide monofilament and is capable of retaining the woven surface stably with firm knuckle portions. This invention relates to a monofilament obtained by copolymerizing two polyamides. It has characteristics in its components, mixing ratio, concentration of an amide group and melt viscosity.

The polyamide monofilament disclosed in the above-described invention has a wet/dry tensile strength ratio of 85% or greater, a wet/dry flexural rigidity ratio of 55% or greater, maximum longitudinal dimensional change of 4% or less due to moisture absorption or desorption, and a heat set tension ratio, as expressed by a ratio of a yarn tension at normal temperature to a yarn tension prior to heat treatment when the monofilament is heat set at a temperature of from 100° C. to the melting point under tension and then cooled as is, of 2 times or greater. According to this document, the polyamide monofilament therefore does not lose excellent characteristics of polyamide such as wear resistance, has only a small difference in the characteristics between dry time and wet time, can undergo thermal correction easily even in a fiber state because of excellent heat set property, and maintain a stable woven surface because a firm knuckle portion prevents misalignment of constituent yarns during use. The above-described values of the physical properties of this polyamide monofilament such as wet/dry tensile strength ratio, wet/dry flexural rigidity ratio, the maximum longitudinal dimensional change due to moisture absorption or desorption, and heat set tension ratio are however not special but similar to those of conventional polyamide monofilaments or copolymerized polyamide monofilaments. In particular, it is known that Nylon 6 also shows a heat set tension ratio of two times or greater, and it has the maximum dimensional change of 4% or less. Moreover, even if the monofilament has a high wet/dry rigidity and improved heat set tension ratio, it does not mean that an industrial fabric obtained using it has a firm knuckle portion and becomes stable without misalignment of constituent yarns upon use.

Thus, even if the polyamide monofilament has such a novel constitution, fabrics obtained by weaving it are not worth using as an industrial fabric when they cannot have physical properties suited for the intended industrial fabric. Moreover, it is difficult for the fabric as disclosed by the above-described patent document to satisfy the properties required for an industrial fabric such as fabric rigidity such as diagonal rigidity and flexural rigidity, dimensional stability, wear resistance, surface property and running stability.

An object of the present invention is to provide an industrial fabric excellent in fabric rigidity such as diagonal rigidity and flexural rigidity, weaving strength, dimensional stability, running stability, fibrillation resistance, wear resistance, resistance to moist heat, heat resistance, and chemical resistance and is stable without causing misalignment of constituent yarns: and a constituent yarn of the fabric.

In the present invention, a polyamide obtained by polycondensation reaction between metaxylenediamine and adipic acid is called "Polyamide (A)", while another polyamide is called "Polyamide (B)". A yarn composed of a polyamide obtained by mixing from 5 to 50 wt. % of Polyamide (A) with from 95 to 50 wt. % of Polyamide (B) is called "polyamide filament (M)".

The present invention relates to a polyamide filament used for an industrial fabric, which comprises a polyamide resin composition obtained by mixing from 5 to 50 wt. % of a crystalline polyamide (A) obtained by polycondensation reaction of metaxylenediamine and adipic acid and from 95 to 50 wt. % of another polyamide (B). After heating (to 160 to 200° C.) under a constant length condition (at an initial load of 20 mg/d), the filament does not reduce a thermal contraction stress thereof in a cool-down region not greater than 80° C. The polyamide filament may be a monofilament or multifilament. The polyamide (B) may be any one of Polyamide 6, Polyamide 66, Polyamide 610, Polyamide 612 and a polyamide copolymer or a mixture of two or more thereof. From 20 to 40 wt. % of the crystalline polyamide (A) may be mixed with from 80 to 60 wt. % of the another polyamide (B). The polyamide filament as described above may be used as at least a portion of wefts and warps of an industrial fabric.

The present invention relates to a polyamide filament obtained by mixing predetermined amounts of specified two polyamides and does not reduce its thermal contraction stress by cooling to room temperature after heating; and an industrial fabric using this filament as a constituent yarn of the fabric. This fabric is excellent in fabric rigidity such as diagonal rigidity and flexural rigidity, weaving strength, dimensional stability, running stability, fibrillation resistance, wear resistance, resistance to moist heat, heat resistance, and chemical resistance and is stable without causing misalignment of constituent yarns; and is suited for papermaking fabric, filter cloth of a dehydrator or conveyer belt.

BRIEF DESCRIPTION OF THE DRAWING

The drawing FIGURE is a graph showing a thermal contraction stress of several polyamide monofilaments.

DETAILED DESCRIPTION OF THE INVENTION

In order to overcome the above-described problem, provided in the present invention are: a polyamide filament (M) which is obtained by mixing from 5 to 50 wt. % of a crystalline polyamide (A) prepared by polycondensation reaction between metaxylenediamine and adipic acid and from 95 to 50 wt. % of another polyamide (B), and after heating (to 160 to 200° C.) under a constant length condition (at initial load: 20 mg/d), does not undergo a reduction in its thermal contraction stress in a cool-down region not greater than 80° C.; and an industrial fabric using the polyamide filament (M) as at least a portion of warps and wefts. The fabric obtained according to the present invention is excellent in fabric rigidity such as diagonal rigidity and flexural rigidity, dimensional stability, running stability, wear resistance, resistance to moist heat, fibrillation resistance, and chemical resistance and is stable without causing misalignment of constituent yarns.

The crystalline polyamide (A) available by the polycondensation reaction of metaxylenediamine and adipic acid and usable in the present invention is excellent in hydrolysis resistance, resistance to moist heat, resistance to dry heat and wear resistance and features high strength and high rigidity. The another polyamide (B) is, for example, Polyamide 6, Polyamide 66, Polyamide 610 and Polyamide 612, and copolymer of polyamide, polyamide obtained by mixing one or more than one polyamides and it is excellent in wear resistance and shower resistance.

For the polyamide filament (M) which is a constituent yarn of the present invention, a mixing ratio of the crystalline polyamide (A) and another polyamide (B) is an important factor. When the amount of the crystalline polyamide (A) exceeds 50 wt. %, the polyamide (A) which is stiff and has weak fibrillation resistance serves as sea in the sea-island structure so that the resulting filament has physical properties influenced greatly by the rigidity of the crystalline polyamide (A) and has deteriorated fibrillation resistance. Such a filament sometimes cracks by the contact with a foil or the like or a high-pressure shower.

When the amount of the crystalline polyamide (A) is less than 5 wt. %, the resulting filament becomes a filament not suited for industrial fabric because of deteriorations in heat resistance, dry heat resistance, chemical resistance and abrasion resistance. As a result of extensive investigation by the present inventor, a polyamide filament obtained by mixing from 5 to 50 wt. % of a crystalline polyamide (A) prepared by polycondensation reaction between metaxylenediamine and adipic acid and from 95 to 50 wt. % of another polyamide (B) satisfies the object of the present invention. A filament obtained by mixing from 20 to 40 wt. % of a crystalline polyamide (A) and from 80 to 60 wt. % of another polyamide (B) is more preferred.

The polyamide filament (M) is a filament equipped with a special physical property, that is, when the filament is cooled after heating (to 160 to 200° C.) under a constant length condition (at an initial load of 20 mg/d), it does not reduce its thermal contraction stress in a cool-down region not greater than 80° C. In other words, it has a thermal contraction stress which increases or is fixed at a temperature not greater than 80° C. In general, industrial fabric is heat set to about 160 to 200° C. after weaving in order to form a knuckle at the intersections between yarns, thereby stabilizing the attitude of the fabric. Without heating, the yarns constituting the fabric are only crossed each other and misalignment occurs, which leads to a sleazy fabric. In the filaments made of a synthetic resin, at intersections between warps and wefts, knuckles in the form following their shapes are formed in order to get tangle warps and wefts by heating. The thermal contraction stress increases by heating and owing to a tension thus produced, yarns thus crossed each other are tangled more strongly, whereby the fabric is able to have a stable attitude as a whole. Polyester monofilaments which have excellent rigidity and dimensional stability and therefore are suited for an industrial fabric hardly undergo a reduction in a thermal contraction stress during cooling. When they are heat set once, knuckles are formed firmly even under normal temperature and any problem such as misalignment of constituent yarns and bow of fabric does not occur. Although industrial fabrics made of only polyester monofilaments have been used, many fabrics are obtained by weaving polyester monofilaments and polyamide monofilaments in order to impart them with improved wear resistance and impact resistance.

Ordinary union fabrics are not completely satisfactory as an industrial fabric because rigidity and dimensional stability lower owing to water absorption of polyamide monofilaments. Different from polyester monofilaments, polyamide monofilaments tend to cause misalignment of constituent yarns even after heat setting and the resulting fabric inevitably becomes sleazy. In ordinary polyamide monofilaments, at intersections between warps and wefts, knuckles in the form following their shapes are formed in order to get tangle warps and wefts by heating. The thermal contraction stress increases by heating and owing to a tension thus produced, yarns thus crossed each other are tangled more strongly, whereby the fabric is able to have a stable attitude as a whole. After heat setting, however, the thermal contraction stress gradually lowers during a cooling step, which leads to a reduction in the tension of wefts and warps which have been interwoven strongly when the temperature is high. For example, Nylon 6, Nylon 610 or Nylon 6/Nylon 66 copolymer nylon shows the highest thermal contraction stress at about 160 to 200° C. and this thermal contraction stress decreases by subsequent cooling. In particular, Nylon 610 shows a marked decrease in contraction stress. In other words, an industrial fabric obtained by weaving such polyamide monofilaments, knuckles once formed by heat setting become loose and a space appears between yarns, which have been crossed each other, by a reduction in the thermal contraction stress, resulting in a fabric with misalignment or shift of yarns. Even if polyamide monofilaments are woven with polyester monofilaments, their reduction in thermal contraction stress cannot be overcome.

In the present invention, after heating, the polyamide filament (M) which is a constituent yarn of a woven fabric does not undergo a reduction in thermal contraction stress in a cool-down region not greater than 80° C. so that an industrial fabric excellent in diagonal rigidity and flexural rigidity and stable without causing misalignment of constituent yarns can be obtained.

In the fabric of the present invention, the above-described polyamide filament may be used as at least a portion of constituent yarns of the fabric. It can be used as some or all of wefts and warps. In general, it is preferred to use as wefts instead of a polyamide which is required to have wear resistance and shower resistance. It can also be woven with a polyester filament which hardly undergoes a reduction in thermal contraction stress during cooling. This makes it possible to manufacture a fabric which easily causes neither misalignment of constituent yarns nor bow of fabric and is excellent in diagonal rigidity, flexural rigidity, dimensional stability, running stability, wear resistance, moist heat resistance, dry heat resistance, fibrillation resistance and chemical resistance.

As the structure of the fabric, any one of single layer fabric and multilayer fabrics such as double layer fabric and triple layer fabric can be used. No particular limitation is imposed on the weave pattern. It may be used for some of upper surface side wefts, auxiliary wefts of small diameter placed between upper surface side wefts, binding yarns and lower surface side wefts of a double-layer fabric. It can be used as a monofilament, multifilament and crimped yarn.

Moreover, the industrial fabric may be subjected to antifouling resin processing. An antifouling effect can be maintained long from the beginning to the end of use when a resin adsorptive to the polyamide filament is used.

EXAMPLES

Examples of the present invention will next be described while comparing with the conventional examples.

Various physical properties, necessary when used industrially, of the monofilament having the constitution of the present invention, another filament, and fabrics woven with these monofilaments were measured. First, thermal contraction stress of several monofilaments different in material quality were measured.

1. Comparison Test of Monofilament 1-1. Measurement Test on the Thermal Contraction Stress of Monofilament Samples were each heated (at 180° C.) under a constant length condition (at initial load: 20 mg/d) by using a thermal contraction stress tester (manufactured by Kanebo). The temperature was then decreased and in a cool-down region not greater than 80° C., their thermal contraction stress was compared (refer to FIG. 1).

"Samples"

Sample 1: A polyamide monofilament (M1) of the present invention obtained by mixing 25 wt. % of a crystalline polyamide (A) prepared by the polycondensation reaction between metaxylenediamine and adipic acid and 75 wt. % of Nylon 6 (B).

Sample 2: A polyamide monofilament (M2) of the present invention obtained by mixing 5 wt. % of a crystalline polyamide (A) prepared by the polycondensation reaction between metaxylenediamine and adipic acid and 95 wt. % of Nylon 6 (B).

Sample 3: Nylon 6

Sample 4: Nylon 6/Nylon 66 copolymer nylon

Sample 5: Nylon 610

Results of Thermal Contraction Stress Test

By this test, thermal contraction stress of a yarn constituting a fabric is measured. Results of this test serve as an indicator of attitude stability, after heat setting, of a fabric woven with each yarn sample. It is the common practice to use an industrial fabric after heat setting the woven fabric to about 160 to 200° C. to provide the fabric with attitude stability so that the attitude stability of the fabric after heat setting was evaluated on the assumption of this heat setting. In FIG. 1, temperature (° C.) is plotted along the right ordinate, while thermal contraction stress (g) is plotted along the left ordinate. A dotted line shows a graph of temperature. The yarn is heated from room temperature to 180° C. and then cooled to room temperature. Bold lines are graphs of a thermal contraction stress of the polyamide monofilament (M1) and polyamide monofilament (M2) of the present invention.

All the polyamide monofilaments provided for the test were heated to 180° C. under the same conditions, followed by cooling to room temperature. A thermal contraction stress in a cool-down region not greater than 80° C. was compared.

During heating, all the yarns in FIG. 1 show a gradual increase in thermal contraction stress. During cooling after that, a thermal contraction stress tends to show a gradual decrease. In Samples 3 to 5, after heat setting, a tension gradually lowers with a reduction in the thermal contraction stress and a space appears between knuckles, resulting in a fabric having misalignment of constituent yarns and bow. In a cool-down temperature region not greater than 80° C., on the other hand, the polyamide monofilament (M1) of the present invention shows a gradual increase in a thermal contraction stress. The polyamide monofilament (M2) of the present invention does not undergo a reduction in thermal contraction stress and maintains almost a constant value in a cool-down region not greater than 80° C. An increase in thermal contraction stress means that when a constituent yarn is heated, knuckles at intersections between warps and wefts of the fabric, in the form following their shapes, are formed by heating and owing to a tension produced by an increase in thermal contraction stress, yarns crossing each other are tangled strongly. As a result, the fabric acquires stable attitude as a whole.

In the polyamide monofilaments (M1) and (M2) of the present invention, a thermal contraction stress once decreases, but a decrease is smaller compared with the other polyamides. During the cooling step to a temperature not greater than 80° C., they do not show a decrease in thermal contraction stress so that knuckle form is maintained, problems such as misalignment of constituent yarns or bow of fabric do not occur and the fabric becomes excellent in attitude stability, diagonal rigidity and flexural rigidity.

Sample 2 (M2) is a polyamide monofilament composed of 5 wt. % of (A) and 95 wt. % of (B) and its thermal contraction stress in a cool-down region not greater than 80° C. is almost constant. Amounts of (A) less than 5 wt. % are not preferred, because a decrease in thermal contraction stress does not stop. It is therefore necessary to add at least 5 wt. % of (A). Although Samples 1 and 2 use Nylon 6 as (B), Nylon 66N, 610N or 612N may be used instead. A monofilament added with Nylon 6N is however preferred, because a decrease in thermal contraction stress is the smallest.

A monofilament which does not undergo a decrease in thermal contraction stress in a cool-down region can be prepared using (A) in an amount of 5 wt. % or greater and (B) in an amount not greater than 95 wt. %, but it is recommended to set an upper limit to (A)/(B)=50/50 in order to impart the fabric with physical properties necessary for an industrial fabric.

Samples 3, 4 and 5, which are the other polyamide monofilaments, each shows a gradual decrease in thermal contraction stress when the temperature approaches to room temperature. In particular, Nylon 610 cannot maintain its constant length condition as a result of rapid decrease in thermal contraction stress after heat setting. In the industrial fabrics woven with these polyamide monofilaments, knuckles once formed by heat setting lose its original shape, and a space appears between yarns, which have crossed each other, owing to a reduction in thermal contraction stress. As a result, the resulting fabrics have misalignment of constituent yarns or bow, which leads to deteriorations in attitude stability, diagonal rigidity and flexural rigidity. Such fabrics are gradually stretched by application of a tension thereto and finally disturb stable running.

1-2. Impact Crack Resistance Test of Monofilament

Impact crack resistance test of monofilaments was performed and only the monofilament superior in impact crack resistance to polyester monofilament was judged practically usable as an industrial fabric.

Results of Impact Crack Resistance Test of Monofilament

Test samples were prepared by using a monofilament having a diameter of 0.22, cutting it into pieces of 120 mm long, placing them in parallel to each other with their both ends neatly arranged and bending them into a U-shape together. The samples were each fixed to a rotor so that it was caused to collide, at its bottom of the U-shape, with a stainless pipe. Collision was thus caused under equal conditions. The rotor was turned at 1500 rpm in such a manner that the bottom of the U-shape collided with the stainless pipe, and the number of rotation until crack of the monofilament occurred (until the monofilament was torn or broken) was measured. In such a manner, impact crack resistance of each monofilament was compared.

TABLE 1

| Amount of (A) added | Amount of (B) added (6N) | Number of collision until occurrence of crack |
|---|---|---|
| 0 | 100 | 50000 |
| 25 | 75 | 18000 |
| 55 | 45 | 3000 |
| Polyester 100% | | 4000 |

The above-descried results suggest that the monofilaments containing (A) and (B) at a (A):(B) ratio of 0:100 and 25:75 are superior in impact crack resistance to a polyester monofilament. The monofilament containing (A) and (B) at a (A):(B) ratio of 55:45 is inferior in impact crack resistance to the polyester filament and the industrial fabric prepared using it is evaluated as not suited for practical use because of poor shower resistance and fibrillation resistance.

From the above-described results, it has been found that the upper limit of the content of (A) is 50 wt. %. When the content exceeds it, the physical properties of polyamide, that is, stiff and weak fibrillation resistance have an adverse effect and the resulting polyamide monofilament has only poor impact crack resistance. This makes it difficult to use it as a constituent yarn of an industrial fabric.

Conclusion of Test 1

From the results of the thermal contraction stress test conducted in Test 1-1 using monofilaments, it has been understood that in order to manufacture a fabric excellent in attitude stability without misalignment of constituent yarns and bow of fabric even after heat setting, running stability, diagonal rigidity and flexural rigidity, a polyamide filament obtained by mixing 5 wt. % or greater of a crystalline polyamide prepared by the polycodensation reaction of metaxylenediamine and adipic cid and 95 wt. % or less of another polyamide (B) must be used as a portion of yarns constituting the fabric. From the results of the impact crack resistance test conducted in Test 1-2 using monofilaments, it has been understood that in order to manufacture a fabric excellent in impact crack resistance such as shower resistance and fibrillation resistance, a polyamide filament obtained by mixing 50 wt. % or less of a crystalline polyamide (A) available by the polycondensation reaction between metaxylenediamine and adipic acid and 50 wt. % or greater of another polyamide (B) must be used as a portion of yarns constituting the fabric. In short, monofilaments become suited for industrial use when they are prepared mixing (A) and (B) at a ratio falling within a range of 5 to 50:95 to 50.

2. Comparison Test of Fabrics

A two-layer fabric using, as a portion of upper wefts, a monofilament showing (A):(B)=25:75 was used as an invention fabric of Example 1, while a two-layer fabric using, as a portion of upper wefts, a Nylon 6 monofilament was used as conventional example 1. The above-described monofilament and a polyester monofilament equal in diameter were arranged at 1:1 for each of the upper wefts. The fabrics used in Comparison Tests 2-1 and 2-2 were two-layer fabrics obtained by weaving an upper-layer fabric and a lower-layer fabric with a binding yarn. The two-layer fabric of Conventional Example 1 was similar to that of Example 1 in diameter, material and count of yarns constituting the fabric except for the use of Nylon 6 monofilament instead of the polyamide monofilament.

2-1. Measurement test of diagonal rigidity: A fabric was cut into a square of 100 mm. A load of 500 g was applied to a diagonal direction. The elongation at that time was measured and used as an indicator of diagonal rigidity of the fabric (refer to Table 2).

2-2. Measurement test of bending moment (stiffness): Two test pieces were prepared by cutting the fabric into a 30 mm×70 mm piece and a 70 mm×30 mm piece. Bending moments in the machine direction and cross direction of the fabric were measured using "Taber stiffness tester" (product of Kumagai Riko Kogyo Co., Ltd.) and they were used as an indicator of the rigidity of the fabric (refer to Table 2).

TABLE 2

| | | | Example 1 | Conventional example 1 |
|---|---|---|---|---|
| Diameter (mm) | Upper-layer fabric | Warp | 0.22 (PET) | 0.22 (PET) |
| | | Weft | 0.22 (PET) | 0.22 (PET) |
| | | | 0.22 (*M1) | 0.22 (6N) |
| | Lower-layer fabric | Warp | 0.30 (PET) | 0.30 (PET) |
| | | Weft | 0.40 (PET) | 0.40 (PET) |
| | | | 0.40 (6N) | 0.40 (6N) |
| | Binding yarn | | 0.17 (6N) | 0.17 (6N) |
| | Diagonal rigidity (% elongation in the diagonal direction) | | 0.7 | 2.1 |
| Test | Bending moment (N-m) | Machine direction | 57.9 | 49.6 |
| | | Cross direction | 30.4 | 24.6 |

*M1: Polyamide monofilament obtained by mixing at least 25 wt. % of crystalline polyamide (A) available by the polycondensation reaction of metaxylenediamine and adipic acid and 75 wt. % or less of another polyamide (B).

Results of Diagonal Rigidity Test

This test was performed to measure the rigidity of a fabric in a diagonal direction. With an increase in the value, the percent elongation in the diagonal direction becomes greater. It causes phenomena such as deformation of the fabric into rhombus during using or arched deformation of weft, which sometimes causes width shrinkage or deteriorates its running property. Moreover, an increase in the weight of a conveyed good causes deformation of the fabric, which sometimes disturbs stable running. The fabric of Example 1 shows 0.7% elongation and is therefore not stretchy, while the fabric in Conventional Example shows 2.1% elongation and is therefore more stretchy than that of Example 1.

Results of Bending Moment (Stiffness)

This test was performed to measure the bending moments in the machine direction and cross direction of a fabric as an indicator of the rigidity of the fabric. The bending moment was measured by applying a bending load to a test piece to cause a fixed flexural deformation and the stiffness of the sample was determined from the load at that time. As the bending moment is greater, the rigidity of the fabric is higher and the fabric is more stable without causing deformation or arched deformation of the fabric or width shrinkage. Compared with the fabrics of Conventional Examples 1 and 2, the fabric of Example 1 has higher bending moments in both the machine and cross directions, suggesting that this fabric has excellent flexural rigidity.

The above-described test results have revealed that the fabric of the present invention causes neither misalignment of constituent yarns nor bow of the fabric, is excellent in diagonal rigidity, flexural rigidity and dimensional stability, and does not cause deformation or arched deformation compared with the conventional fabric.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2004-033372 filed Nov. 17, 2004 including specification, drawings and claims is incorporated herein by reference in its entirety.

What is claimed is:

1. A polyamide filament comprising:

a polyamide resin composition obtained by mixing (a) a crystalline polyamide (A), obtained by a polycondensation reaction of metaxylenediamine and adipic acid, in an amount of 5 wt. % of the resin, with (b) Nylon 6 in an amount of 95 wt. % of the resin, wherein after heating (to 160° to 200° C.) under a constant length condition (at an initial load of 20 mg/d), a thermal contraction stress of the filament is not reduced in a cool-down region not greater than 80° C.

* * * * *